US007109927B2

(12) United States Patent
Gilbert et al.

(10) Patent No.: US 7,109,927 B2
(45) Date of Patent: Sep. 19, 2006

(54) MINIATURE MULTI-BAND, ELECTRICALLY FOLDED, MONOPOLE ANTENNA

(75) Inventors: Roland A Gilbert, Milford, NH (US); John T Apostolos, Merrimack, NH (US)

(73) Assignee: Bae Systems Information and Electronic Systems Integration INC, Nashua, NH (US)

( * ) Notice: Subject to any disclaimer, the term of this patent is extended or adjusted under 35 U.S.C. 154(b) by 97 days.

(21) Appl. No.: 11/005,729

(22) Filed: Dec. 7, 2004

(65) Prior Publication Data

US 2006/0119526 A1 Jun. 8, 2006

(51) Int. Cl.
*H01Q 1/38* (2006.01)

(52) U.S. Cl. ..... 343/700 MS; 343/795; 343/803; 343/873

(58) Field of Classification Search ..... 343/700 MS, 343/795, 803, 873
See application file for complete search history.

(56) References Cited

U.S. PATENT DOCUMENTS 4,115,783 A 9/1978 Reggia
4,656,482 A 4/1987 Peng
4,896,162 A 1/1990 Parham
4,939,525 A 7/1990 Brunner
5,016,022 A 5/1991 Kershaw
5,402,136 A 3/1995 Goto et al.
6,590,543 B1 7/2003 Apostolos
6,963,309 B1 * 11/2005 Andersson et al. .. 343/700 MS
2002/0196707 A1 12/2002 Kitchin et al.
2003/0197658 A1 10/2003 Lilly et al.
2004/0061652 A1 4/2004 Ishihara et al.
2004/0178957 A1 9/2004 Chang et al.

OTHER PUBLICATIONS

"Advanced Air Deploy Sonobuoy", www.jhualp.edu, pp. 1-2, Ref # P01741.

* cited by examiner

*Primary Examiner*—Tan Ho
*Assistant Examiner*—Dieu Hien Duong
(74) *Attorney, Agent, or Firm*—Maine & Asmus

(57) ABSTRACT

A miniature broadband monopole antenna design configured with integrated band-selecting filtering is disclosed. The antenna is electrically folded, and includes top and bottom monopole sections, with a meanderline to provide an inductive load between the two sections. The overall antenna structure can be embedded in a relatively small, RF transparent, composite structure (e.g., such as the fin of a guided munition), and has minimal impact on aerodynamics (low drag). The top, bottom, and meanderline elements of the antenna operate together to collectively provide multi-band operation (e.g., 30 MHz to 3 GHz).

20 Claims, 5 Drawing Sheets

MINIATURE MULTI-BAND, ELECTRICALLY FOLDED, MONOPOLE ANTENNA

FIELD OF THE INVENTION

The present invention relates to antennas, and more particularly to a broadband virtually folded monopole antenna configured with integrated band-selecting filtering.

BACKGROUND OF THE INVENTION

A monopole antenna is a resonant antenna, with its optimal length being one quarter of the wavelength of the signal being received or transmitted by the antenna. The antenna impedance for a monopole is a function of the length of the monopole in terms of wavelengths. A quarter wavelength monopole antenna is about 36 ohms, and is purely resistive.

When the antenna is much shorter than a quarter wavelength of the signal being received or transmitted by the antenna, the antenna's impedance is mostly capacitive, with very little resistance. This situation generally occurs at the lower frequencies of the antenna's operating range (where the wavelength of the signal being received or transmitted is at the high end of its range), particularly in applications where the antenna structure must operate over a wide frequency band. In narrow band applications, an inductor or coil is used to negate the capacitive reactance. For wide band applications, however, this is problematic, as it becomes difficult to match impedance in order to couple sufficient power into the RF circuitry for good signal to noise ratio (SNR).

One conventional technique here is to use two antennas of scaled dimensions connected through a diplexer, where one antenna is configured to cover the lower portion of the frequency band, and the other antenna is configured to cover the upper portion of the frequency band. However, the lower frequency portion of the antenna must be of sufficient length to operate. In applications where physical space is limited, the antenna length required to provide sufficient gain may be too large.

What is needed, therefore, is a miniature broadband monopole antenna configuration.

SUMMARY OF THE INVENTION

One embodiment of the present invention provides a miniature electrically folded monopole antenna. The antenna includes a top monopole section configured with a planar portion that tapers down to an extended portion. A planar bottom monopole section forms a capacitor with the planar portion of the top monopole section, and a meanderline is coupled to the bottom monopole section at one end, and is coupled to the wide portion of the top monopole section at its other end, thereby enabling receipt of signals in a low frequency band. The antenna can be configured to provide multi-band operation.

For example, the top monopole section can be adapted for receiving signals in the low frequency band, while the planar bottom monopole section can be adapted for receiving signals in a high frequency band. The capacitor formed by the planar bottom monopole section and the planar portion of the top monopole section can be configured to enable receipt of signals in a mid frequency band. In one example case, the low frequency band is about 300 MHz or less (e.g., 30 MHz to 300 MHz), and the mid frequency band ranges from about 300 MHz to 1 GHz, and the high frequency band about 1 GHz and above (e.g., 1 GHz to 3 GHz).

In one particular application, the antenna is embedded in a fin of a guided munition, where the fin is constructed of electromagnetic transparent composite material, thereby allowing the antenna to direction find on a homing signal. Here, the extended portion of the top monopole section could extend beyond the fin. Note that the extended portion of the top monopole section can be telescoped within the planar portion of the top monopole section prior to being deployed. In one such case, the extended portion of the top monopole section self-extends beyond the fin when the fin is deployed. This self-extending can be achieved, for example, through the use of a stacer spring. Further note that the planar bottom monopole section can be configured to taper down to a feed connector.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE INVENTION

Embodiments of the present invention provide a miniature broadband monopole antenna design configured with integrated band-selecting filtering. The antenna is electrically folded, and includes top and bottom monopole sections, with a meanderline to provide an inductive load between the two sections. The overall antenna structure can be embedded in a relatively small composite structure (RF transparent), and has minimal impact on the aerodynamics (low drag).

In one particular application, the antenna design provides multiple monopole antenna elements (top, bottom, and meanderline sections) that are embedded in the wings or control fins of a missile or other guided munition to direction find on a homing signal. A portion of the antenna extends out beyond the fin tip, and has minimal impact on the trajectory of the munition.

Here, the operating frequency range is from about 30 MHz to 3 GHz, and is broken into three bands. The first band is from about 30 MHz to 300 MHz, the second band is from about 300 MHz to 1 GHz, and the third band is from about 1 GHz to 3 GHz. The antenna radiation pattern resembles that of a monopole mounted on the side of a cylinder with a forward and up/down look, with reference to the trajectory of the guided munition. The gain of the antenna increases with increasing frequency, topping at around 5 dBi above 500 MHz. Other configurations and applications will be apparent in light of this disclosure.

Antenna Structure

Figure 1A:
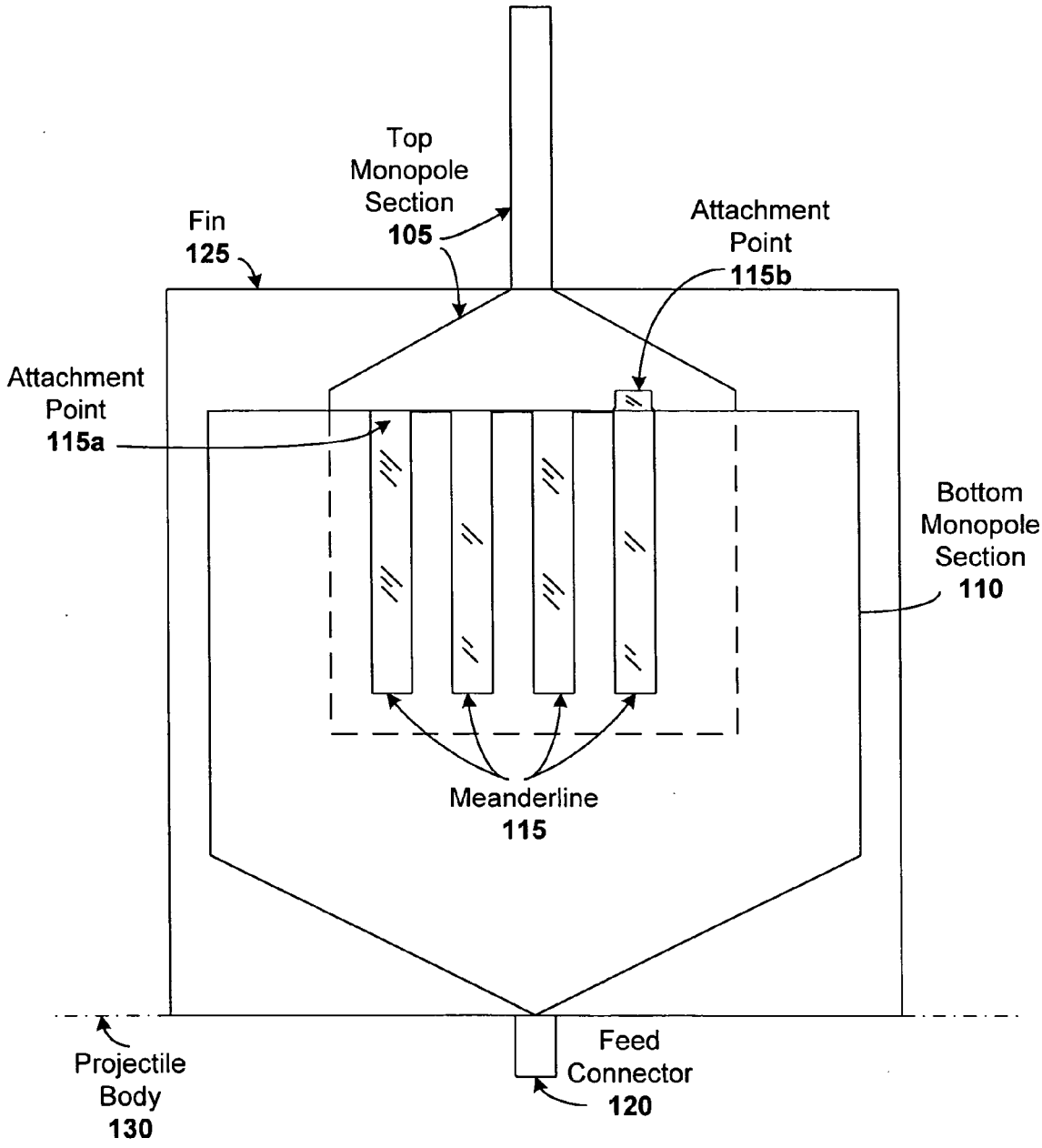
FIG. 1*a* is a top view pictorial diagram of a miniature electrically folded monopole antenna configured in accordance with an embodiment of the present invention.
Figure 1B:
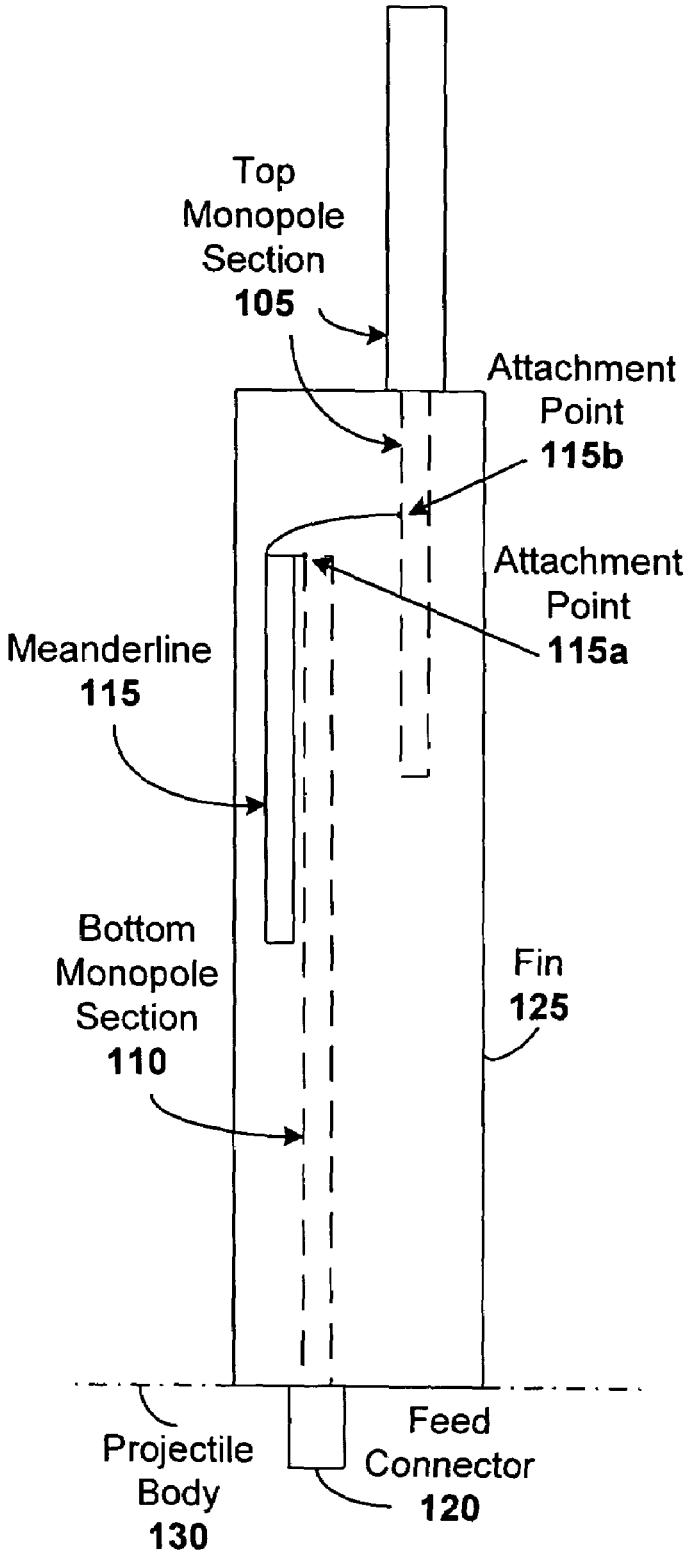
FIG. 1*b* is a side view pictorial diagram of the monopole antenna shown in FIG. 1*a*.

FIGS. 1*a* and 1*b* are top and side views, respectively, of a miniature multi-band, electrically folded monopole antenna configured in accordance with an embodiment of the present invention. The antenna includes a top monopole section 105, a bottom monopole section 110, and a meanderline 115 that is coupled to the bottom monopole section 110 at one end (attachment point 115*a*), and is coupled to the top monopole section 105 at the other end (attachment point 115*b*).

As can be seen, the antenna is embedded in the fin 125 of a projectile body 130 (e.g., guided missile or other munition). The fin 125 is constructed of electromagnetic transparent composite material, thereby allowing the antenna to direction find on a homing signal.

The bottom monopole section 110 is a wide, thin conductive sheet with a tapered lower end that is attached to a feed connector 120 at the center of the fin 125, where it joins the projectile body 130. This section 110 of the antenna resembles a wide monopole antenna element and has very broadband constant impedance properties at higher frequencies. The top monopole section 105 is also a thin conductive sheet, but narrower relative to the bottom monopole section 110. The portion of the top monopole section 105 that extends beyond the fin 125 can be a rod or strip welded or otherwise coupled to the planar portion of the top monopole section 105. Each of the top and bottom monopole section 105 and 110 can be fabricated, for example, with copper, aluminum, metallized plastic or composite (e.g., covered or plated with aluminum or silver and nickel), or other conductive metals and composite materials.

In this particular example, the top section 105 is about one half the width of the bottom section 110 (left to right), and about three quarters the length of the bottom section 110 (top to bottom). In addition to these width and length dimensions, each of the top section 105 and the bottom section 110 has an end portion that is tapered at about a 30° angle, as shown. The thickness of the sections 105 and 110 can range from, for example, one-sixty-fourth to one-sixteenth inches.

The meanderline 115 is a series of folded high and low impedance transmission line sections (e.g., copper, steel, titanium, or aluminum ribbon). One end of the meanderline 115 is connected to the wide ended section of the bottom monopole section 110 at attachment point 115*a*. The other end of the meanderline 115 is connected to the top monopole section 105 at attachment point 115*b*.

Figure 1C:
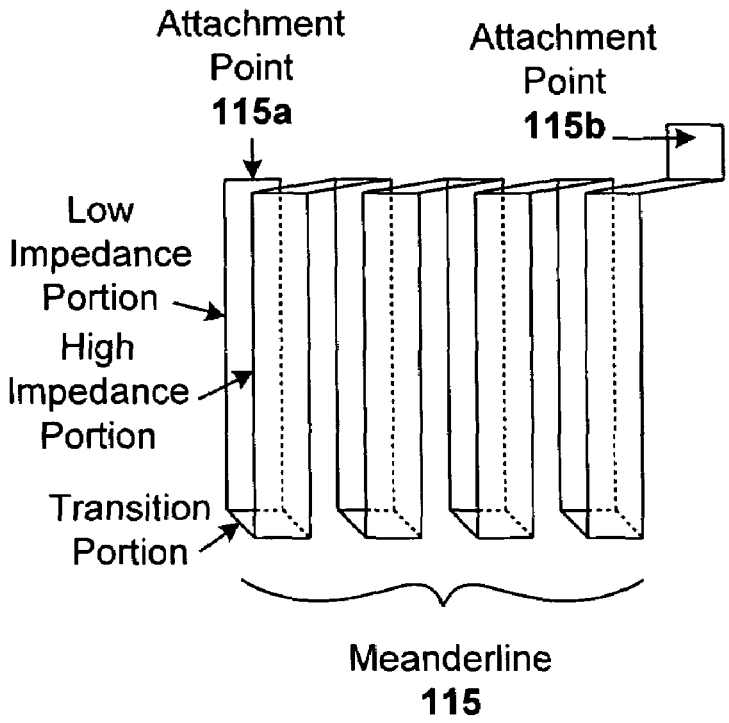
FIG. 1*c* is a perspective view pictorial diagram of the meanderline included in the monopole antenna shown in FIG. 1*a*.

In the embodiment shown, the width of the meanderline 115 is about one-seventh the width of the top monopole section, with each finger extending from the edge of section 110 to about seven-eighths the length of section 110. The thickness of the meanderline 115 can range from, for example, one-sixty-fourth to one-sixteenth inches. The meanderline 115 can be connected at the attachment points 115*a* and 115*b*, for example, with a weld or solder. FIG. 1*c* shows a perspective view of the meanderline 115, so that the low impedance, high impedance, and transition portions can be seen as the meanderline 115 travels from the attachment point 115*a* location to attachment point 115*b* location. The distances of the low impedance and high impedance portions from section 110 are determined by that spacing which would provide, for example, 30 to 40 ohms within the composite material for the low impedance portions, and 130 to 170 ohms for the high impedance portions. Other configurations can have any number of impedance schemes, depending on the particular application.

For instantaneous ultra broadband operation, the number of high and low impedance sections of the meanderline 115 is chosen to provide the best efficiency near the lower end of the operating band. Until the meanderline 115 sections are naturally bypassed as the frequency of operation is increased in the antenna, optimum efficiency might not be obtained at the higher frequencies because the meanderline 115 sections are too long electrically. To obtain optimum efficiency, switches (e.g., microelectromechanical systems switches, diodes, and relays) can be utilized between the high and low impedance portions of the to add or remove sections of the meanderline 115 as needed. Example switching schemes are discussed in U.S. Pat. No. 6,791,502, titled "Stagger Tuned Meanderline Loaded Antenna" which is herein incorporated by reference in its entirety.

The meanderline 115 uses the bottom monopole section 110 as a ground plane, but is isolated electrically from the bottom monopole section 110 except where it connects to the top of section 110 at attachment point 115*a*. The meanderline 115 effectively adds an inductive load between the top monopole section 105 and the bottom monopole section 110. This alone adds electrical length to the antenna for better operation at the low end of the operating frequency band (e.g., 30 MHz to 300 MHz). The portion of the top monopole section 105 that extends beyond the fin 125 further adds length to the monopole to improve low frequency operation.

However, these features do not help the antenna in the mid-band (e.g., 300 MHz to 1 GHz) due to the increasing inductive reactance with increasing frequency. Therefore, to compensate for inductive reactance, the top monopole section 105 that sticks out of the fin 125 is capacitively coupled to the wide bottom monopole section 110. In particular, the part of the top monopole section 105 that connects to the other end of the meanderline 115 at connection point 115*b* and is embedded in the fin 125 is purposefully made wider to establish a capacitor between the top monopole section 105 and the bottom monopole section 110.

The rapid tapering of the base of the top monopole section 105 provides a self-choking inductance which is very helpful at the high end of the operating frequency band (e.g., 1 GHz to 3 GHz), whereby the top monopole section 105 is effectively disconnected from the bottom monopole section 110 at about 1 to 2 GHZ.

Thus, the antenna structure shown provides a tri-band configuration: 30 MHz to 300 MHz, 300 MHz to 1 GHz, and 1 GHz to 3 GHz. Other multi-band configurations will be apparent in light of this disclosure, and the present invention is not intended to be limited to any one such configuration.

In cases where very high antenna efficiency is required at low frequencies, it is possible to resonate the antenna with the meanderline 115 inductance and the compensating capacitance between the top monopole section 105 and the bottom monopole section 110. In the case of broadband reception, this resonance is not desired and the choice of reactive values will be selected to prevent this resonance from happening in order to have a smooth but predictable antenna impedance profile versus operating frequency.

Figure 1D:
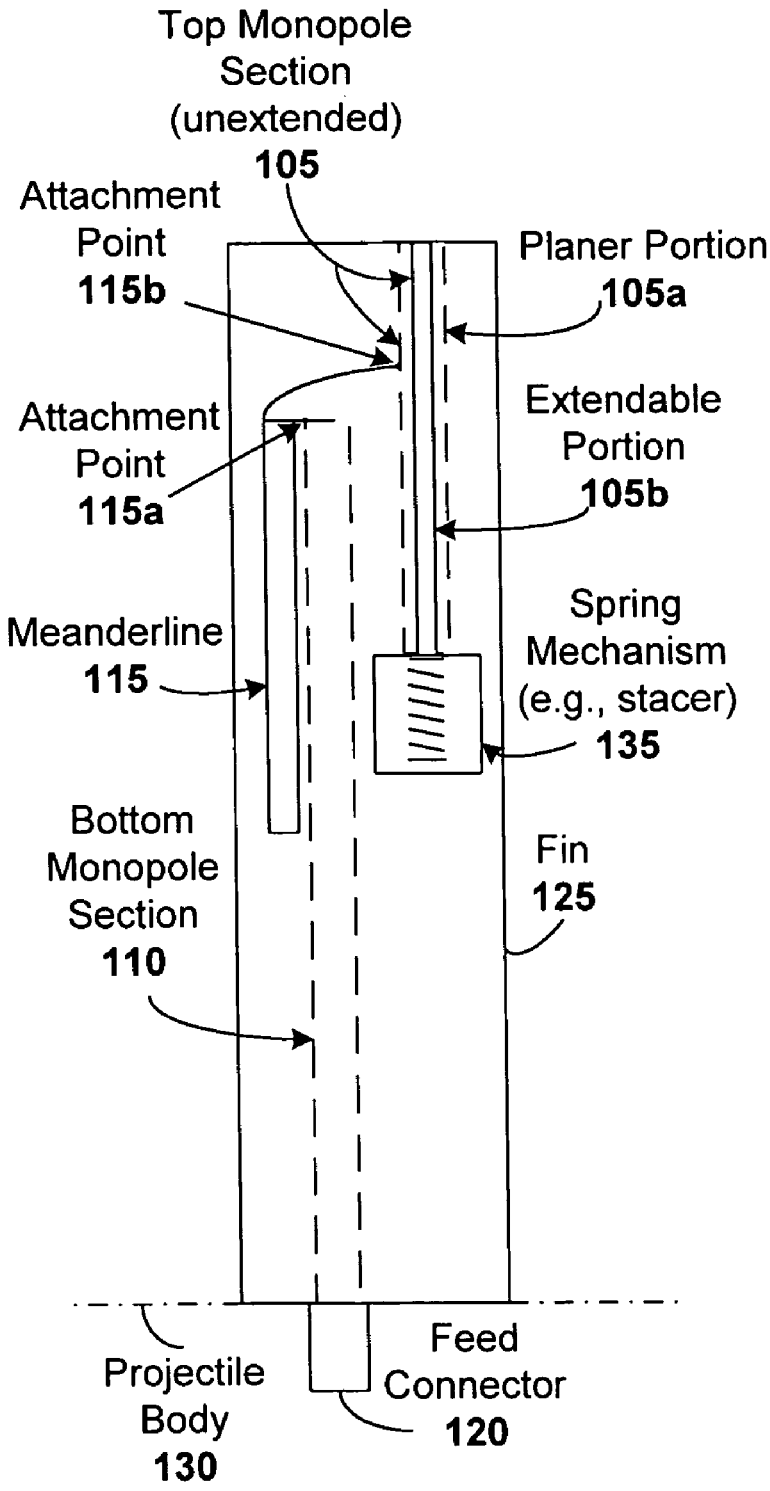
FIG. 1*d* is a side view pictorial diagram of the monopole antenna configured with an extendable portion, in accordance with another embodiment of the present invention.

Note that the portion of the top monopole section 105 that extends beyond the fin 125 can be deployed after the fin 125 is deployed by using a self-extending stacer or other spring mechanism. One such embodiment is shown in FIG. 1*d*. The stacer 135 (e.g., beryllium copper or other spring material) can be configured, for instance, to self-extend the extendable portion 105*b* of the top monopole section 105 about six inches beyond the fin 125, thereby increasing the aperture of the antenna. In the unextended state, the extendable portion 105*b* is telescoped within the planar portion 105*a* of the top monopole section 105.

Once the fin 125 is deployed, the stacer 135 pushes the extendable portion 105*b* out to its extended position beyond the fin 125. The force exerted by the stacer spring 135 is sufficient to rapidly extend the extendable portion 105*b*, and to ensure a robust and continuous electrical and mechanical contact between the planar portion 105*a* and the retained end of the extendable portion 105*b*. The length that the extendable portion 105*b* extends beyond the fin 125 will depend on a number of factors, such as the low operating frequency range and the amount of tolerable drag. Other spring arrangements can be used here as well.

Antenna Equivalent Circuit

Figure 2:
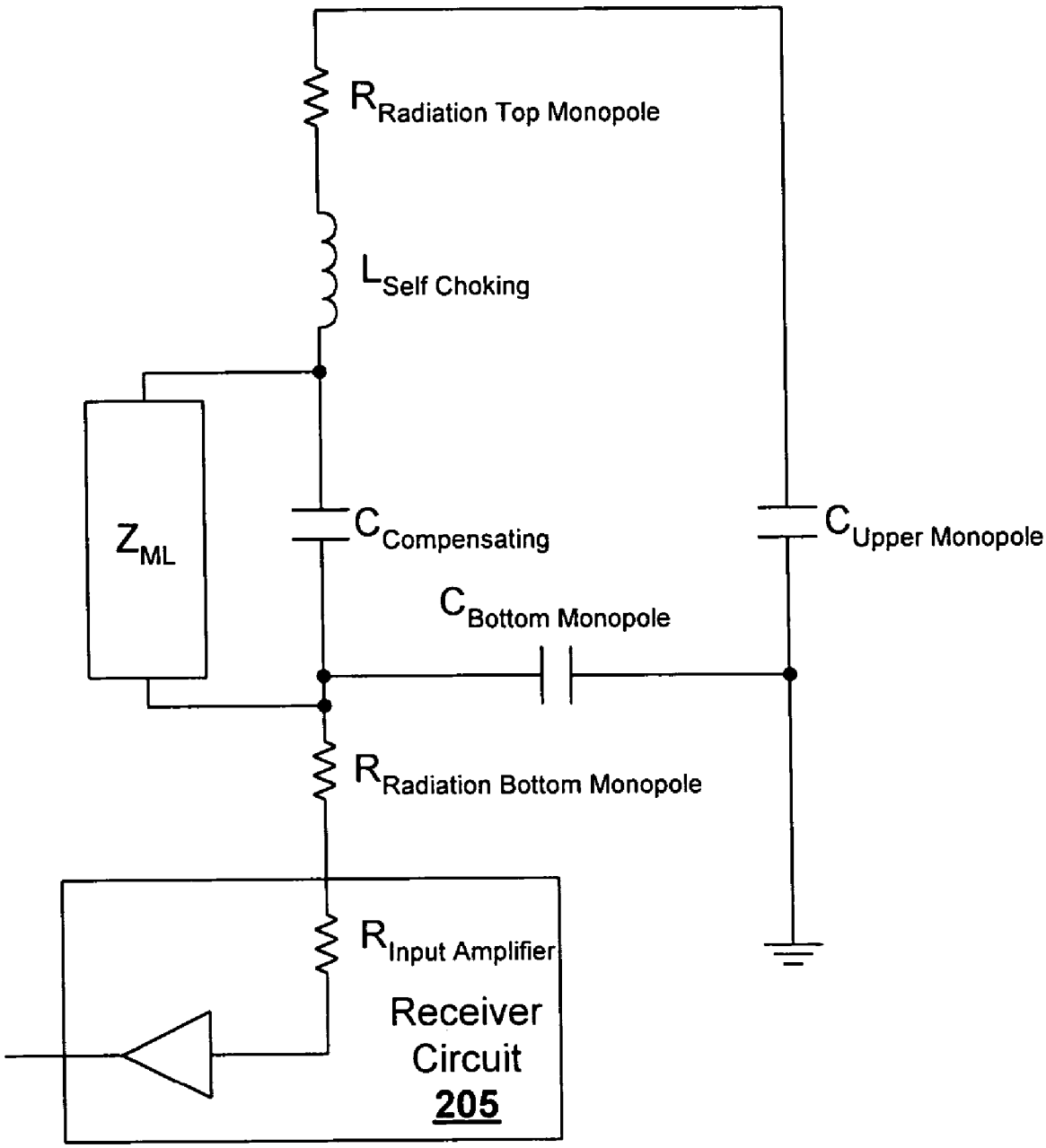
FIG. 2 is an equivalent circuit of the monopole antenna shown in FIG. 1*a*.

FIG. 2 is an equivalent circuit of the monopole antenna shown in FIG. 1*a*. As can be seen, each of the top and bottom monopole sections 105 and 110 is associated with a radiation resistance ($R_{Radiation\ Top\ Monopole\ and}$ $R_{Radiation\ Bottom\ Monopole}$). Likewise, each of the top and bottom monopole sections 105 and 110 is associated with a capacitance ($C_{Top\ Monopole\ and}$ $C_{Bottom\ Monopole}$).

As previously explained, the meanderline 115 uses the bottom monopole section 110 as a ground plane, but is isolated electrically from the bottom monopole section 110 except where it connects to the top of section 110 at attachment point 115*a*. The meanderline 115 effectively provides the inductive load ($Z_{ML}$) between the radiation resistance of the top monopole section 105 ($R_{Radiation\ Top\ Monopole}$) and the radiation resistance the bottom monopole section 110 ($R_{Radiation\ Bottom\ Monopole}$).

To compensate for the inductive reactance of the meanderline 115, the part of the top monopole section 105 that is embedded in the fin 125 is purposefully made wider to establish a capacitor ($C_{Compensating}$) in conjunction with the wide bottom monopole section 110. This $C_{Compensating}$ is in parallel with $Z_{ML}$, between the $R_{Radiation\ Top\ Monopole}$ and $R_{Radiation\ Bottom\ Monopole}$.

The rapid tapering of the base of the top monopole section 105 provides the self-choking inductance ($L_{Self\ Choking}$). Note that the amplifier of the receiver circuit 205 is associated with an input resistance ($R_{Input\ Amplifier}$), which is effectively in series with $R_{Radiation\ Bottom\ Monopole}$. Further note that the feed connector 120 is between these two resistances.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A miniature multi-band, electrically folded monopole antenna, comprising:

a top monopole section configured with a planar portion that tapers down to an extended portion, and is adapted for receiving signals in a low frequency band;

a planar bottom monopole section adapted for receiving signals in a high frequency band, wherein the planar bottom monopole section forms a capacitor with the planar portion of the top monopole section, thereby enabling receipt of signals in a mid frequency band; and a meanderline that is coupled to the bottom monopole section at one end, and is coupled to the wide portion of the top monopole section at its other end, thereby further enabling receipt of signals in the low frequency band.

2. The system of claim 1 wherein the antenna is embedded in a fin of a guided munition, and the fin is constructed of electromagnetic transparent composite material, thereby allowing the antenna to direction find on a homing signal.

3. The system of claim 2 wherein the extended portion of the top monopole section extends beyond the fin.

4. The system of claim 2 wherein the extended portion of the top monopole section self-extends beyond the fin when the fin is deployed.

5. The system of claim 2 wherein the extended portion of the top monopole section self-extends beyond the fin when the fin is deployed through the use of a stacer spring.

6. The system of claim 2 wherein the extended portion of the top monopole section is telescoped within the planar portion of the top monopole section prior to being deployed.

7. The system of claim 1 wherein the low frequency band ranges from about 30 MHz to 300 MHz, and the mid frequency band ranges from about 300 MHz to 1 GHz, and the high frequency band ranges from about 1 GHz to 3 GHz.

8. The system of claim 1 wherein the planar bottom monopole section tapers down to a feed connector.

9. A miniature multi-band monopole antenna embedded in a fin of a guided munition, comprising:

a top monopole section configured with a planar portion that tapers down to an extended portion that extends beyond the fin, and is adapted for receiving signals below about 300 MHz;

a planar bottom monopole section adapted for receiving signals above about 1 GHz, wherein the planar bottom monopole section forms a capacitor with the planar portion of the top monopole section, thereby enabling receipt of signals between about 300 MHz and 1 GHz; and a meanderline that is coupled to the bottom monopole section at one end, and is coupled to the wide portion of the top monopole section at its other end, thereby further enabling receipt of signals in the low frequency band.

10. The system of claim 9 wherein the extended portion of the top monopole section self-extends beyond the fin when the fin is deployed.

11. The system of claim 9 wherein the extended portion of the top monopole section self-extends beyond the fin when the fin is deployed through the use of a stacer spring.

12. The system of claim 9 wherein the extended portion of the top monopole section is telescoped within the planar portion of the top monopole section prior to being deployed.

13. The system of claim 9 wherein the planar bottom monopole section tapers down to a feed connector on the guided munition.

14. A miniature electrically folded monopole antenna, comprising:

a top monopole section configured with a planar portion that tapers down to an extended portion;

a planar bottom monopole section that forms a capacitor with the planar portion of the top monopole section; and a meanderline that is coupled to the bottom monopole section at one end, and is coupled to the wide portion of the top monopole section at its other end, thereby enabling receipt of signals in a low frequency band.

15. The system of claim 14 wherein the antenna is embedded in a fin of a guided munition, and the fin is constructed of electromagnetic transparent composite material, thereby allowing the antenna to direction find on a homing signal.

16. The system of claim 15 wherein the extended portion of the top monopole section extends beyond the fin.

17. The system of claim 15 wherein the extended portion of the top monopole section self-extends beyond the fin when the fin is deployed.

18. The system of claim 17 wherein the extended portion of the top monopole section is telescoped within the planar portion of the top monopole section prior to being deployed, and self-extends through the use of a stacer spring.

19. The system of claim 14 wherein the antenna is configured to provide multi-band operation.

20. The system of claim 14 wherein the planar bottom monopole section tapers down to a feed connector.

* * * * *